US006774794B2

(12) United States Patent
Zimmerman et al.

(10) Patent No.: US 6,774,794 B2
(45) Date of Patent: Aug. 10, 2004

(54) METHODS AND APPARATUS FOR ATTACHING AN ELECTRONIC PRICE LABEL TO AN ELECTRONIC THEFT PREVENTION TAG

(75) Inventors: Terry Lee Zimmerman, Lawrenceville, GA (US); Marc Bennett Lynn, Suwanee, GA (US)

(73) Assignee: NCR Corporation, Dayton, OH (US)

( * ) Notice: Subject to any disclaimer, the term of this patent is extended or adjusted under 35 U.S.C. 154(b) by 237 days.

(21) Appl. No.: 10/036,821

(22) Filed: Dec. 21, 2001

(65) Prior Publication Data

US 2003/0116632 A1 Jun. 26, 2003

(51) Int. Cl.[7] ..... G08B 13/14

(52) U.S. Cl. ..... 340/572.8; 340/572.9; 340/5.91; 340/568.1; 340/693.5

(58) Field of Search ..... 340/572.8, 572.9, 340/5.91, 568.1, 693.5; 70/391, 416, 453; 292/217, 218, 220

(56) References Cited

U.S. PATENT DOCUMENTS

| | | | | | |
|---|---|---|---|---|---|
| 3,914,829 | A | * | 10/1975 | Paskert | 70/57.1 |
| 3,942,829 | A | * | 3/1976 | Humble et al. | 70/57.1 |
| 3,974,581 | A | * | 8/1976 | Martens et al. | 340/572.7 |
| 5,151,684 | A | * | 9/1992 | Johnsen | 340/568.1 |
| 5,619,416 | A | * | 4/1997 | Kosarew | 700/225 |
| 5,942,978 | A | * | 8/1999 | Shafer | 340/572.9 |

* cited by examiner

*Primary Examiner*—Jeffery Hofsass
*Assistant Examiner*—Hung Nguyen
(74) *Attorney, Agent, or Firm*—Priest & Goldstein, PLLC; Paul W. Martin

(57) ABSTRACT

An electronic price label is described which can be secured to a product by attaching the label to a theft prevention tag and securing the tag to the product. The label includes a display portion attached to an extension which can be retained within the theft prevention tag when the tag is closed and which extends out of the theft prevention tag so that the label is visible outside of the theft prevention tag.

4 Claims, 6 Drawing Sheets

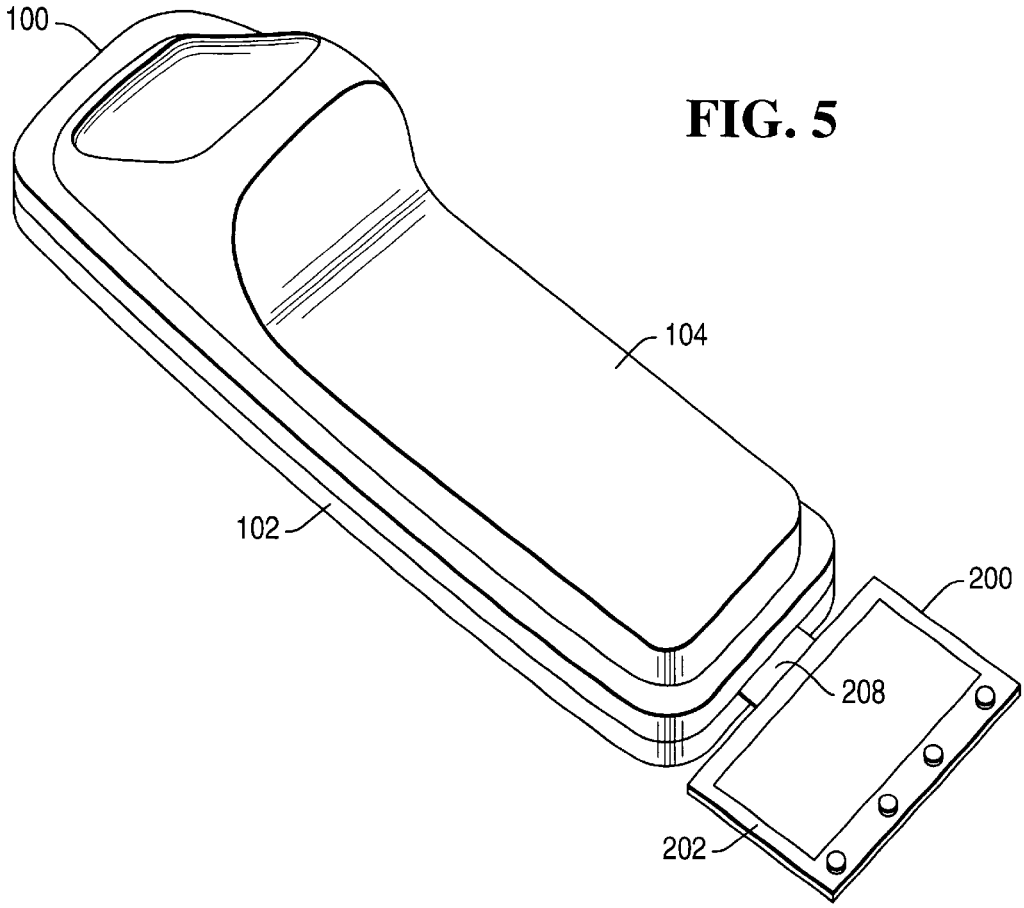
FIG. 5
FIG. 7
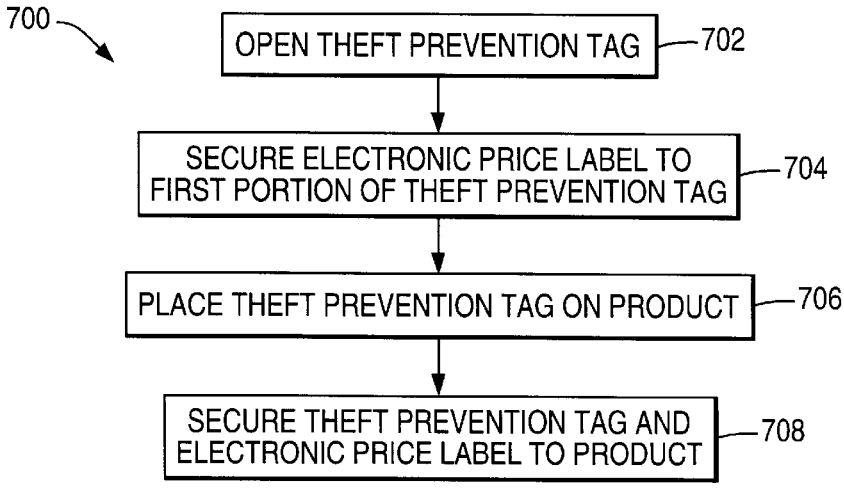

METHODS AND APPARATUS FOR ATTACHING AN ELECTRONIC PRICE LABEL TO AN ELECTRONIC THEFT PREVENTION TAG

FIELD OF THE INVENTION

The present invention relates generally to electronic price labels. More particularly, the invention relates to techniques for attaching an electronic price label to an electronic theft prevention tag and securing the combined electronic price label to a product.

BACKGROUND OF THE INVENTION

Electronic price labels are convenient and widely used. By using electronic price labels and associated broadcasting systems, a retailer can broadcast information such as price information about a product to each of a plurality of labels and can update the information transmitted to a label or a group of labels by changing the information being broadcast, without a need to go to each label in order to remove it or change it. The label is able to change its display as new information is broadcast and to display the new information being transmitted.

Relatively high value products often have theft prevention devices, such as electronic tags, attached to them. Typically, a plastic tag with any of a variety of security features is securely attached to a product and requires the use of a specially designed retailer operated device for its removal. The tag may emit signals or fields which are detectable when the tag passes a sensor, resulting in the sounding of an alarm. For example, if a customer proceeds out of the store without paying for a protected article, the tag is detected at the exit of the store and store personnel are alerted in a well-known fashion. If an electronic price label could be secured to a theft prevention tag, both the tag and the label could be attached as a unit to a product, allowing electronic transmission of price and other desired information and its display using the label, while simultaneously allowing theft prevention provided by the tag. Only one attachment to the product would be required.

SUMMARY OF THE INVENTION

An electronic price label according to an aspect of the present invention preferably includes a preferably plastic housing enclosing a display and other electronic components within the label. The display and other electronic components allow the label to receive and display broadcast or otherwise electronically transmitted product and price information. Attached to the housing is an extension which can be secured to a theft prevention tag. The tag serves to hold the extension, and thus the label, in place when the tag is secured to a product. The extension may suitably be a relatively flat plastic piece having a hole near one end of the extension. The hole allows the plastic piece to be penetrated by a pin such as may be included in many popular theft prevention tags. Such a tag frequently includes a first and a second portion with a pin passing from the first portion to the second portion when the tag is secured in place. The pin passes through the product to which the tag is secured, and when an electronic label according to the present invention is secured to such a tag and the tag is secured to a product, the pin passes from the first portion of the tag through the hole in the extension of the electronic price label, through the product, and into the second portion of the tag. Both the tag and the label are thus held securely in place.

Securing the label to a theft prevention tag and then securing the tag and label to an article provides numerous advantages in many retail environments. In clothing stores, clothing prices are often displayed on paper tags which may be difficult for a consumer to find. The weight of a theft prevention tag, however, tends to reveal its location on an article, and if an electronic price label is secured to a theft prevention tag, the price label can be found by locating the theft prevention tag.

In addition, paper tags may fall off of articles of clothing, and articles of clothing may become rearranged or misplaced, because of handling of the articles and trying on of the articles by customers who then abandon the articles or return them to incorrect racks or bins. The misplacement of articles of clothing tends to create confusion, especially if some articles of clothing are discounted while other similar items are undiscounted or subject to different discounts. Often, the price labels on products are not changed every time the product is discounted, and the fact that a product has been discounted is made known to customers by a sign on a rack or bin. If an article of clothing is misplaced, a customer may be misled about the true price of the article. Enclosing an electronic label within a theft prevention tag provides a securely attached price label and also makes it possible to easily change price labels on clothing to reflect current pricing including any discounts.

A more complete understanding of the present invention, as well as further features and advantages of the invention, will be apparent from the following Detailed Description and the accompanying drawings.

BRIEF DESCRIPTION OF THE DRAWINGS

FIG. 5 illustrates an electronic price label according to the present invention, secured within a theft prevention tag;

FIG. 7 illustrates a process according to the present invention for securing a price label to a theft prevention tag and securing the tag and price label to a product.

DETAILED DESCRIPTION

Figure 1:
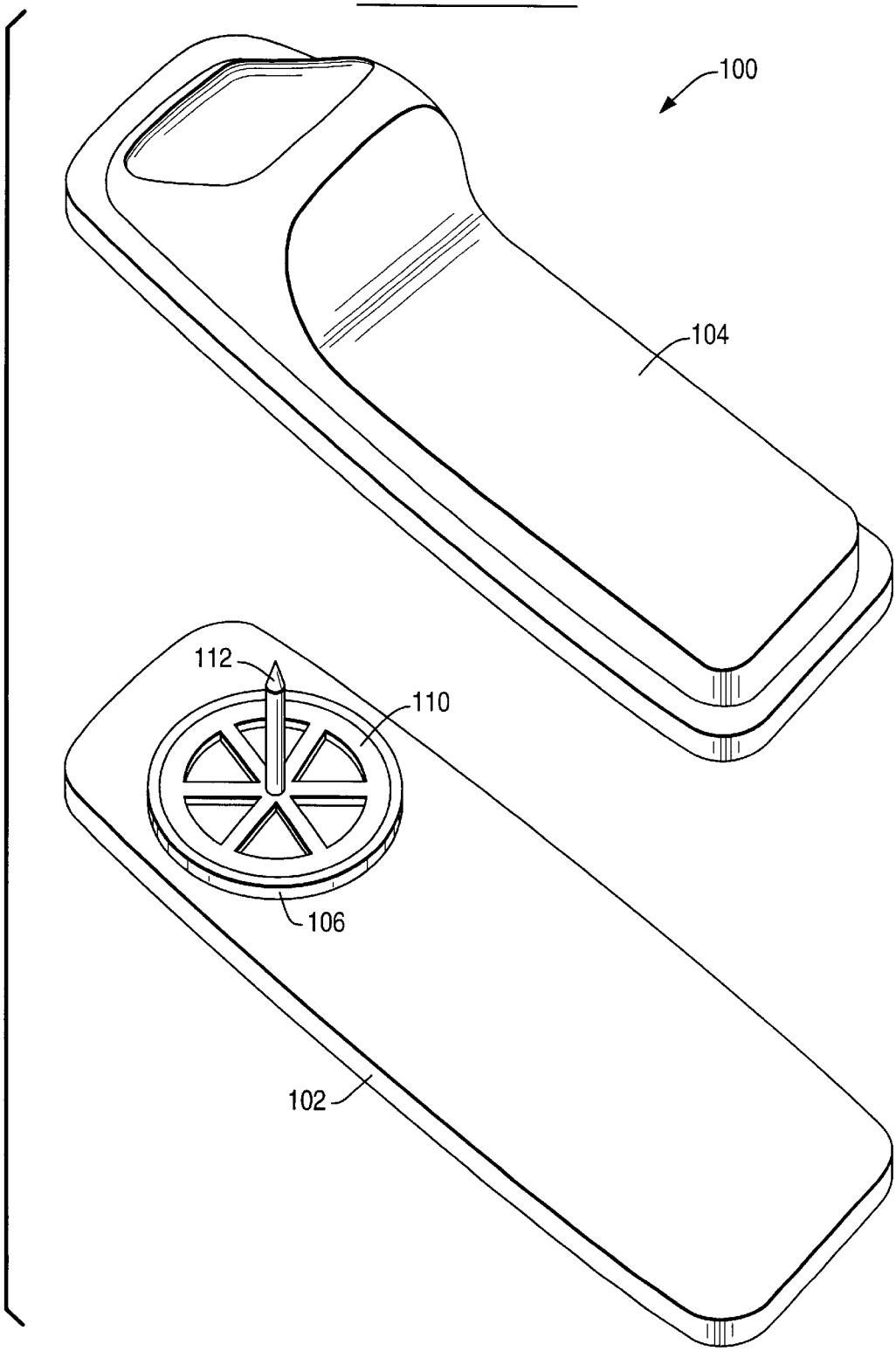
FIG. 1 PRIOR ART
FIG. 1 illustrates a prior-art theft prevention tag.

FIG. 1 illustrates a prior-art theft prevention tag 100 to which an electronic price label according to the present invention may be secured as discussed further below. The tag 100 comprises a first portion 102 and a second portion 104. One or both of the first portion 102 and the second portion 104 include a magnetic material or other object which can be detected by disturbing or emitting a field, or in some other way, so that passage of the tag past a security perimeter can be detected.

The first portion 102 and the second portion 104 are adapted to mate with one another so that they may be secured together in such a way that it is difficult to separate them without the use of special equipment. The first portion 102 of the tag 100 includes a first receptacle 106 in which a tack 110 may be placed. The tack 110 includes a pin 112, which extends into a second receptacle 114 in the second portion 104 when the first portion 102 and the second portion 104 are secured together. The tag 100 is typically secured so that the first portion 102 and the second portion 104 are on opposite sides of a product, with the pin 112 passing from the first portion 102, through the product, and into the second portion 104.

Figure 2:
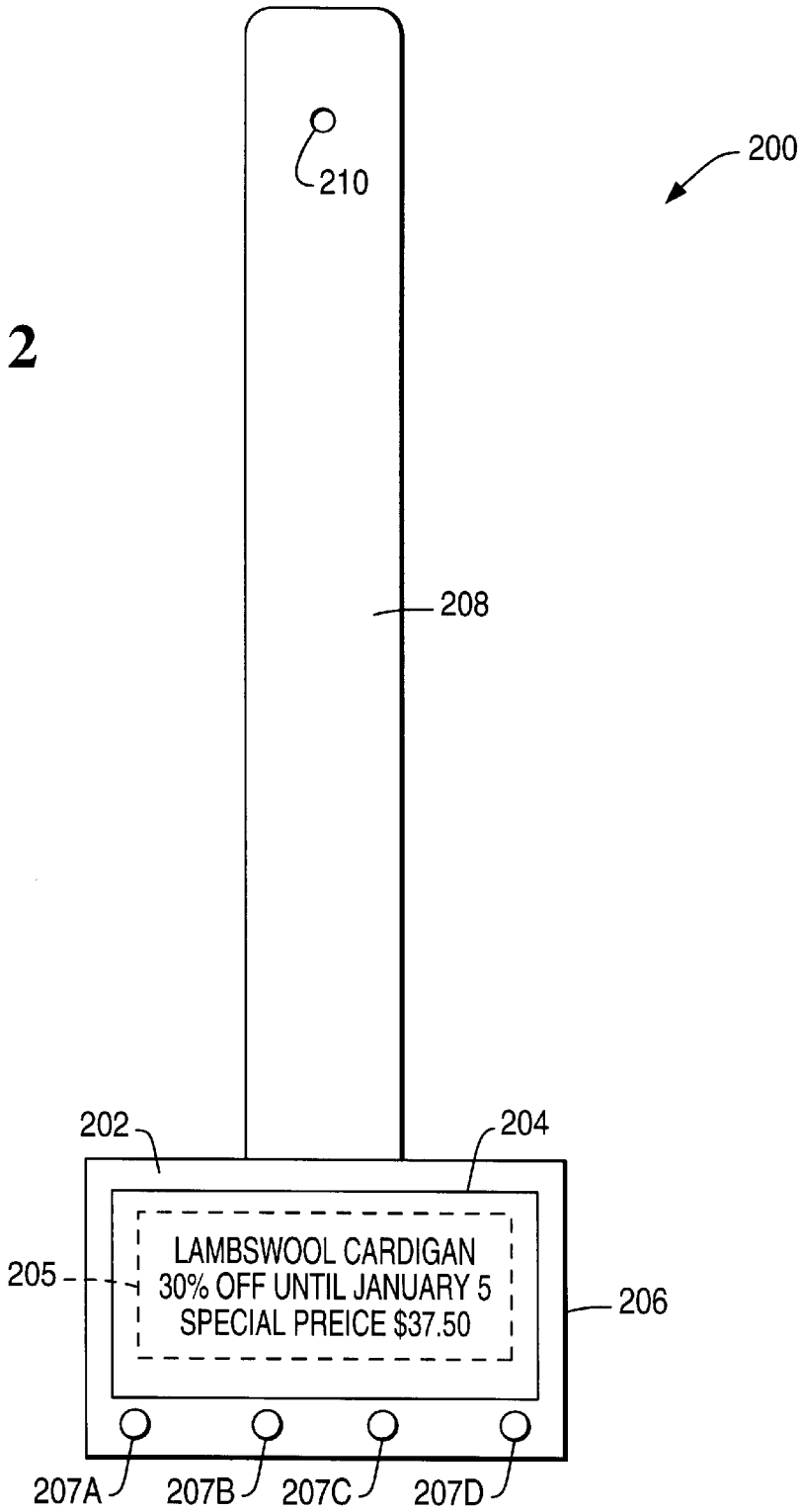
FIG. 2 illustrates an electronic price label according to the present invention.

FIG. 2 illustrates an electronic price label 200 adapted to be secured within a theft prevention tag such as the tag 100 of FIG. 1. The electronic price label includes a display portion 202 comprising a display screen 204 and a housing 206 enclosing the display screen 204. The display screen 204 is shown here as displaying a message 205, including a product description and price and promotional information.

The display portion 202 also includes pushbuttons 207A–207D for selecting from among various display options, as well as internal electronics (not shown) for receiving, storing and displaying price and other product information. The electronic price label 200 also includes an extension 208 attached to the housing 206. The housing 206 and the extension 208 may suitably be plastic, although any other suitable material or combination of materials may be used. The extension 208 and the housing 206 may suitably be molded as a single unit, the extension 208 may be attached to the housing 206 using an ultrasonic or other type of weld, or any of a number of other techniques may be used, depending on the requirements of the specific application.

The extension 208 contains a hole 210, preferably sized so that a pin such as the pin 112 of FIG. 1 fits tightly within it. The extension 208 is preferably of such a length as to extend from the pin 112 to outside of the tag 100. The extension 208 is preferably of such a width as to be enclosed within the tag 100 and of such a thickness that it does not interfere with the closing of the tag 100. When the label 200 is to be used, a tag 100 is selected and the extension 208 is placed on the first portion 102 of the tag 100 such that the pin 112 passes through the hole 210. The extension 208 is aligned with the first portion 102 of the tag and the first portion 102 with the attached label 200 is then placed on a product such that the pin 112 passes through the product. The second portion 104 of the tag 100 is then secured to the first portion 102 of the tag 100 so that the tag 100 and the label 200 are secured to the product in such a way that the display screen 204 is visible.

Figure 3:
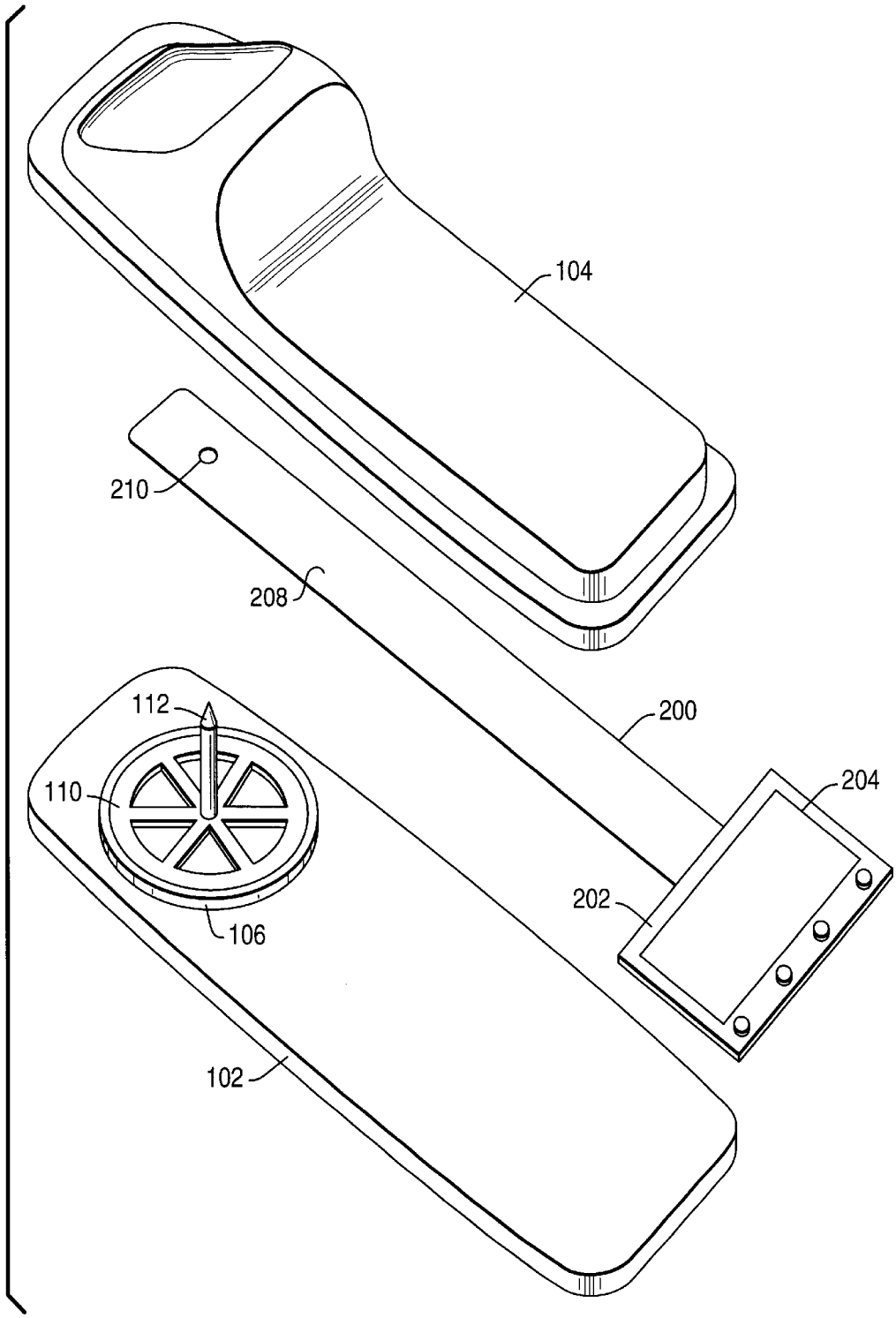
FIG. 3 illustrates an electronic price label according to the present invention, aligned for enclosure within a theft prevention tag.

FIG. 3 illustrates the first portion 102 and the second portion 104 of the tag 100, with the label 200 shown between them and aligned to illustrate its orientation with respect to the tag 100. The receptacle 106, tack 110 and pin 112 are visible within the first portion 102 of the tag 100. The label 200 may be secured to the lower portion 102 so that the pin 112 passes through the hole 210. Upon placement of the label 200 on the lower portion 102, the extension 208 will be aligned with the first portion 102 and the display portion 202 will be located beyond the first portion 102 at an end of the extension 208. In order to secure the tag 100 and label 200 to a product, tag 200 is secured to the first portion 102 and the first portion 102 is placed on one side of the product in such a way that the display portion 202 of the label 200 is easily visible. For example, the lower portion 102 may be placed on the inside of a jacket near the bottom of the jacket such that the pin 112 extends through the jacket and such that most of the lower portion 102, as well as the extension 208 and the display portion 202 of the tag 200, extends below the jacket. The upper portion 104 is then secured to the lower portion 102. The tag 100 is thereby secured to the product. The label 200 is also secured within the tag and the display screen 204 is visible and any information displayed thereon can be read.

Figure 4:
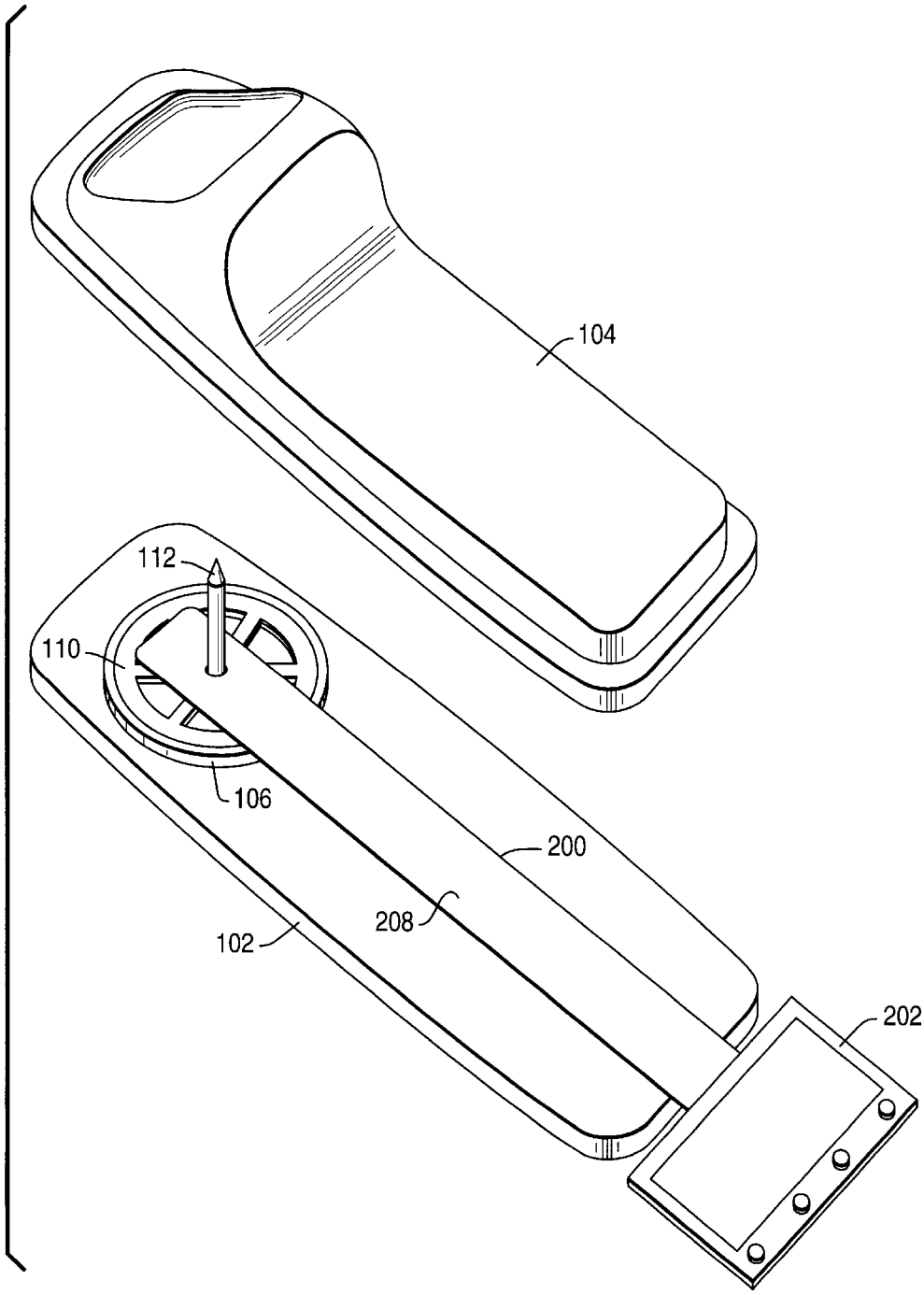
FIG. 4 illustrates an electronic price label according to the present invention, affixed to a first portion of a theft prevention tag.

FIG. 4 illustrates the electronic price label 200, affixed to the first portion 102 of the theft prevention tag 100. The extension 208 is aligned with the first portion 102 of the tag 100 and the display portion 202 of the label 200 extends beyond the first portion 102 of the tag 100, so that the display portion 202 will be visible when the second portion 104 is affixed to the first portion 102. The receptacle 106 and the tack 110 are partially visible, but are obscured by the extension 208. The pin 112 extends through the hole 210, however, the hole 210 is not visible because it is filled by the pin 112.

FIG. 5 illustrates the electronic price label 200, secured within the theft prevention tag 100. The label 200 has been affixed to the first portion 102 of the tag 100, and the second portion 104 has been secured to the first portion 102, securing the extension 208 between the first portion 102 and the second portion 104. The display portion 202 of the label 200 extends beyond the tag 100 and the display screen 204 is visible outside of the tag 100.

Figure 6:
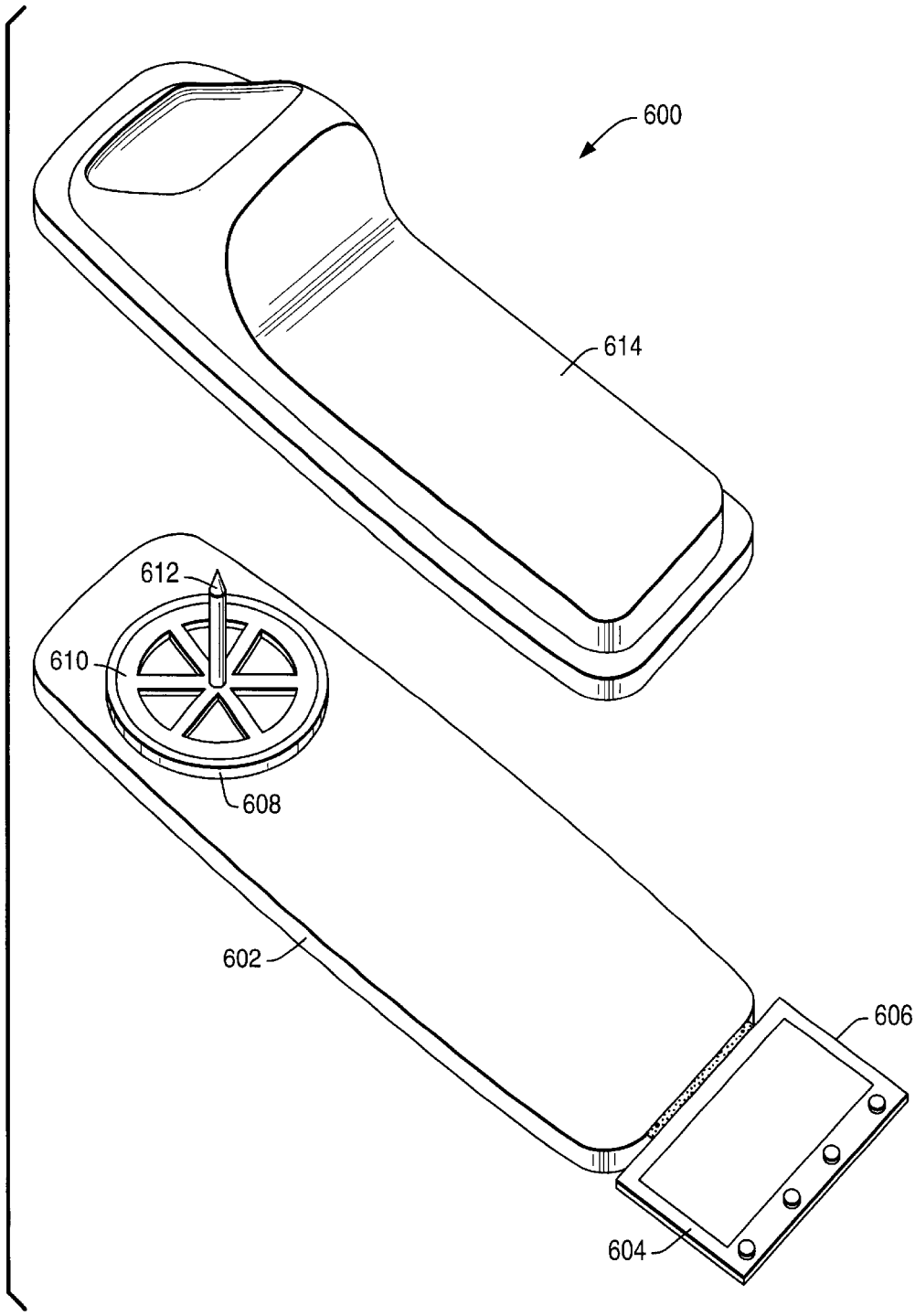
FIG. 6 illustrates a theft prevention tag according to the present invention, including a permanently affixed electronic price label.

FIG. 6 illustrates a combination theft prevention tag and electronic price label 600 according to the present invention. The combination tag and label 600 comprises a first tag portion 602, and a label 604 having a housing 606 attached to the first tag portion 602. The first tag portion 602 and label housing 606 may all be molded from a single piece of plastic, or may be secured together using any other suitable technique. The combination tag and label 600 also includes a receptacle 608, in which a tack 610 may be placed, the tack 610 having a pin 612. The combination tag and label 600 further includes a second tag portion 614, which may be secured to the first tag portion 602 in order to secure the combination tag and label 600 to a product. The pin 612 extends into the second tag portion 614 when the first tag portion 602 and second tag portion 614 are secured together.

FIG. 7 illustrates the steps of a process 700 for attaching a combined theft prevention tag and electronic price label to a product. At step 702, a theft prevention tag is opened, preferably by removing a first portion from a second portion. At step 704, an electronic price label is secured to a first portion of the theft prevention tag. The electronic price label may suitably be similar to the price label 200 of FIG. 2, including a display portion attached to an extension, with the extension having a width and thickness allowing the extension to fit within the width of the theft prevention tag when the theft prevention tag is closed and having a length to extend slightly out of the theft prevention tag so that the display portion is visible outside of the theft prevention tag when the theft prevention tag is closed. At step 706, the theft prevention tag is placed on an article so that the display portion of the electronic price label is visible. At step 708, the theft prevention tag and electronic price label are secured to the article by securing a second portion of the theft prevention tag to the first portion so that the electronic price label is secured to the tag and the tag is secured to the product in such a way that the tag cannot be removed from the product unless the tag is opened.

While the present invention is disclosed in the context of a presently preferred embodiment, it will be recognized that a wide variety of implementations may be employed by persons of ordinary skill in the art consistent with the above discussion and the claims which follow below.

We claim:

1. An electronic label for securing inside a theft prevention tag, comprising:

a display portion including a display and label electronics for receiving price and displaying price and other product information;

an extension attached to the display portion, the extension having a width and thickness such that the extension is retained within the theft prevention tag when the tag is closed, the extension having a length such that the extension extends out of the theft prevention tag such that the display portion is visible outside the theft prevention tag.

2. The label of claim 1 wherein the extension includes a hole sized to accommodate a pin included in a first portion of the theft prevention tag.

3. The label of claim 2 wherein the hole is sized to fit snugly around the pin such that the extension tends to be retained in the first portion of the tag when the tag is opened.

4. The label of claim 3 wherein the extension is plastic.

* * * * *